US006397797B1

(12) United States Patent
Kolmanovsky et al.

(10) Patent No.: US 6,397,797 B1
(45) Date of Patent: Jun. 4, 2002

(54) METHOD OF CONTROLLING VALVE LANDING IN A CAMLESS ENGINE

(75) Inventors: Ilya V Kolmanovsky, Ypsilanti; Mohammad Haghgooie, Ann Arbor; Mazen Hammoud, Dearborn; Michiel Jacques van Nieuwstadt, Ann Arbor, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/732,696

(22) Filed: Dec. 8, 2000

(51) Int. Cl.[7] ..... F01L 9/04
(52) U.S. Cl. ..... 123/90.11; 251/129.1
(58) Field of Search ..... 123/90.11, 90.15; 251/129.1, 129.15, 129.16; 73/118.2, 117.2, 117.3

(56) References Cited

U.S. PATENT DOCUMENTS 4,957,074 A 9/1990 Weissler, II et al.
5,069,422 A 12/1991 Kawamura
5,964,192 A 10/1999 Ishii
5,988,123 A 11/1999 Miyoshi et al.
6,152,094 A * 11/2000 Kirschbaum ..... 123/90.11
6,234,122 B1 * 5/2001 Kirschbaum ..... 123/90.11
6,260,521 B1 * 7/2001 Kirschbaum ..... 123/90.11
6,285,151 B1 * 9/2001 Wright ..... 318/560

* cited by examiner

*Primary Examiner*—Thomas Denion
*Assistant Examiner*—Jaime Corrigan
(74) *Attorney, Agent, or Firm*—Carlos Hanze

(57) ABSTRACT

A method of controlling valve landing in a camless engine including a valve movable between fully open and fully closed positions, and an electromagnetic valve actuator for actuating the valve is provided. The method includes providing at least one discrete position measurement sensor to determine when the valve is at a particular position during valve movement. The velocity of the valve is calculated at the particular position based upon current and rate of change of current in the electromagnetic valve actuator when the valve is at the particular position. Valve landing is controlled based upon the calculated velocity.

15 Claims, 3 Drawing Sheets

METHOD OF CONTROLLING VALVE LANDING IN A CAMLESS ENGINE

TECHNICAL FIELD

The present invention relates to a method of controlling valve landing in a camless engine which uses current and rate of change of current in an electronic valve actuator with discrete position sensors to calculate valve velocity for controlling valve landing.

BACKGROUND ART

Camless engine unthrottled operation enabled by fully actuated valves holds promise for improved fuel economy and drivability. Before this technology becomes production feasible, a number of technical problems need to be resolved. One of the key problems is associated with controlling the contact velocities in the valve actuation mechanism so that a reliable performance without unacceptable noise and vibrations is attained. This problem is often referred to as the soft landing problem (i.e., soft landing of the valve and actuation mechanism at its fully open and fully closed positions).

In a typical electromechanical actuator, the valve motion is affected by the armature that moves between two electromagnetic coils biased by two springs. The valve opening is accomplished by appropriately controlling the lower coil, while the upper coil is used to affect valve closing. High contact velocities of the armature as well as of valve seating may result in unacceptable levels of noise and vibrations. On the other hand, if the coils are not appropriately controlled, the valve landing may not take place at all, thereby resulting in engine failure.

Because the combustion processes in the engine that determine the magnitude of the disturbance force on the valves are stochastic, the disturbance force may vary from cycle-to-cycle. Consequently, a control system that determines the parameters of the coil excitation must combine both in-cycle compensation for the particular disturbance force profile realized within the present cycle, and slower cycle-to-cycle adaptation of the parameters of the excitation, that compensate for engine and actuator assembly aging as well as various other parameter variations.

The solutions proposed in the prior art either do not rely on armature position measurement at all, or they require a position sensing mechanism which continuously senses the location of the valve at all positions. The solutions without a position sensor may not be robust enough as they typically rely on open loop estimation schemes that would be rendered invalid should the engine or actuator assembly parameters change. The main problems with the solutions that rely on a continuous position sensor are the high cost and lack of reliability as the sensor may become inaccurate in the course of operation due to calibration drift.

Accordingly, it is desirable to provide an improved method and system for controlling valve landing in camless engines.

DISCLOSURE OF INVENTION

The present invention provides an improvement over prior art methods of controlling valve landing by using discrete position measurements and estimating valve velocity at these discrete locations based upon current and rate of change of current in an electronic valve actuator. The discrete position measurements are provided, for example, by switch-type position sensors. Specific examples of switch-type position sensors include optical (LED and photo-element based) sensors and magnetic pickup sensors. The number of position sensors could vary within the scope of the present invention, but preferably only three sensors are used to minimize cost.

Accordingly, the present invention provides a method of controlling valve landing in a camless engine including a valve movable between fully open and fully closed positions, and an electromagnetic valve actuator (EVA) for actuating the valve. The method includes providing at least one discrete position measurement sensor to determine when and if the valve is at a particular position during valve movement. The velocity of the valve at the particular position is estimated based upon current and rate of change of current in the electromagnetic valve actuator when the valve is at the particular position. Valve landing is then controlled based upon the estimated velocity.

In a preferred embodiment, three discrete position sensors are provided: with one sensor at the half-way point between fully open and fully closed positions, and the second and third sensors positioned near the fully open and fully closed positions.

Accordingly, an object of the invention is to provide an improved method of controlling valve landing in a camless engine which uses discrete position measurements in conjunction with current and rate of change of current in an electronic valve actuator for calculating velocity at the discrete locations, and thereby controlling valve landing.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 2:
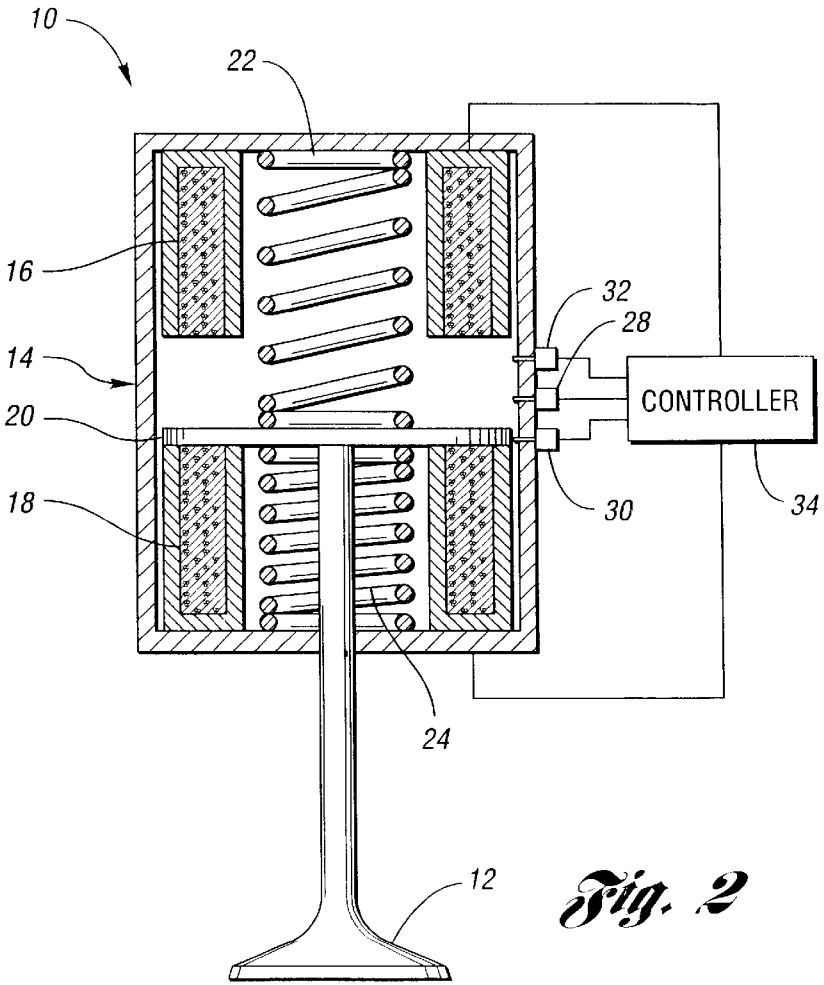
FIG. 2 shows a schematic vertical cross-sectional view of an apparatus for controlling valve landing as shown in FIG. 1, with the valve in the fully open position.
Figure 1:
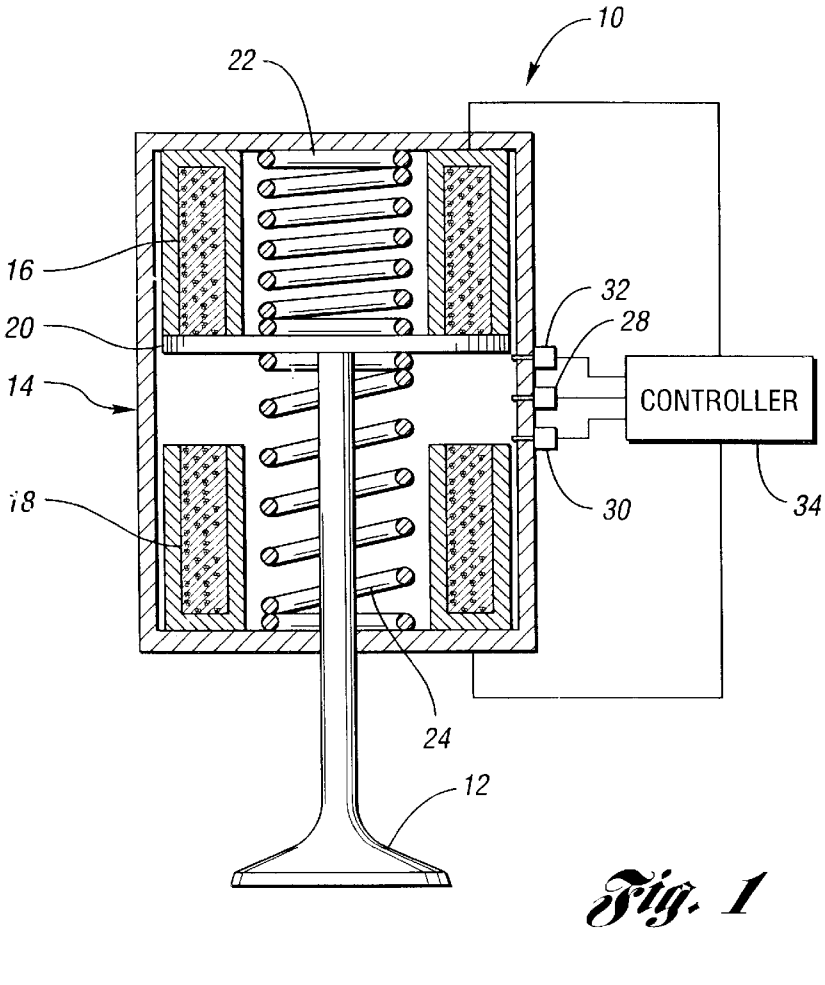
FIG. 1 shows a schematic vertical cross-sectional view of an apparatus for controlling valve landing in accordance with the present invention, with the valve in the fully closed position.

Referring to FIGS. 1 and 2, an apparatus 10 is shown for controlling movement of a valve 12 in a camless engine between a fully closed position (shown in FIG. 1), and a fully open position (shown in FIG. 2). The apparatus 10 includes an electromagnetic valve actuator (EVA) 14 with upper and lower coils 16,18 which electromagnetically drive an armature 20 against the force of upper and lower springs 22,24 for controlling movement of the valve 12.

Switch-type position sensors 28,30,32 are provided and installed so that they switch when the armature 20 crosses the sensor location. It is anticipated that switch-type position sensors can be easily manufactured based on optical technology (e.g., LEDs and photo elements) and when combined with appropriate asynchronous circuitry they would yield a signal with the rising edge when the armature crosses the sensor location. It is furthermore anticipated that these sensors would result in cost reduction as compared to continuous position sensors, and would be highly reliable.

A controller 34 is operatively connected to the position sensors 28,30,32, and to the upper and lower coils 16,18 in order to control actuation and landing of the valve 12.

The first position sensor 28 is located around the middle position between the coils 16,18, the second sensor 30 is located close to the lower coil 18, and the third sensor 32 is located close to the upper coil 16. In the following description, only the valve opening control is described, which uses the first and second sensors 28,30, while the situation for the valve closing is entirely symmetric with the third sensor used in place of the second.

The key disadvantage of the switch-type position sensor as compared to the continuous position sensor is the fact that the velocity information cannot be obtained by simply differentiating the position signal. Rather, the present invention proposes to calculate the velocity based upon the electromagnetic subsystem of the actuator. Specifically, the velocity is estimated based upon the current and rate of change of current in the electromagnetic actuator 14. Because the disturbance due to gas force on the valve does not directly affect the electromagnetic subsystem of the actuator, this velocity estimation can be done reliably. The velocity estimation (assuming no magnetic field saturation) has the form:

$$Velocity = \frac{\left(\frac{z+k_b}{k_a}\right) - (L\cdot i - \varepsilon) + r\cdot i - V}{i\frac{k_a}{(z+k_b)^2}}$$

where, z and Vel are the armature position (distance from an energized coil) and velocity, respectively, r is the electrical resistance, V and i are voltage and current, respectively, and e is the dynamic state of the estimator and is derived from the $d\epsilon/dt$ formula below. L is an estimator gain and $k_a$ and $k_b$ are constants that are determined by magnetic field properties and are calibrated from the relation between the force on the armature and the gap distance between the armature and the lower coil:

$$F_{mag} = \frac{k_a i^2}{(z+k_b)^2}$$

The rate of change of current in the EVA is estimated as $(L\cdot i-\epsilon)$ in the velocity formula above, where $$\frac{d\varepsilon}{dt} = -L\cdot(L\cdot i - \varepsilon)$$

and L>0 is an estimator gain and the actual measurement of the current i is an input to the formula. Accordingly, the calculated velocity is based on current and estimated rate of change of current in the EVA. The estimate is implemented in discretized form on a microprocessor system dedicated to actuator control. The duty cycle of the EVA is the excitation signal on-time divided by total time. The duty excitation signal applied to the lower coil 18 (essentially a fraction of maximum voltage applied to the coil, i.e., $V=V_{max}\cdot d$) during a single cycle is shaped by changing the values of several parameters. One such scheme uses the following parameters:

$T_2$ is the time instant when the duty cycle is applied to effect armature catching;

$d_c$ is the magnitude of the catching duty cycle;

$T_3$ is the time instant when catching action is changed to holding action; and $d_h$ is the magnitude of the holding duty cycle.

An algorithm is proposed for adjusting these parameters that uses the information from the first and second sensors 28,30, and accomplishes the tasks of both in-cycle control and cycle-to-cycle adaptation. When the armature passes the location of a switch-type position sensor, a rising signal edge from a sensor is detected, and the position at this time instant is known. Using the above characterization of the electromagnetic subsystem, the armature velocity is backtracked and used for control. Consequently, the velocity of the first sensor crossing can serve as an early warning about the magnitude of the disturbance affecting the valve motion, and this information can be used for in-cycle control. The cycle-to-cycle adaptation aims at regulating the velocity at the second sensor crossing to the desired value. Experiments show that disturbances on the exhaust valves are largest at the beginning of the valve motion and, hence, regulating the velocity to the desired value near the end of the valve travel can be used as an enforcement mechanism for soft landing. Finally, in situations when a valve is about to malfunction, as may be indicated by a serious velocity deficit at the second sensor crossing or a second crossing of the second sensor occurs, it may be necessary to apply the full duty cycle to ensure landing. In other words, voltage is continuously applied to the lower coil 18.

The below-described algorithm assumes (for simplicity) that the initial catching part of the duty cycle becomes active only after the first sensor crossing. At higher engine speeds, an earlier activation of the duty cycle may be needed to provide faster responses. In this situation, it is possible to use the crossing information from the third sensor 32 instead of the crossing information from the first sensor 28. It is also possible to modify the algorithm so that it only applies to the part of the active duty cycle profile after the first sensor 28 crossing. Finally, it should be clear that the crossing information from all three sensors 28,30,32 can be used to shape the duty cycle within a single valve opening or valve closing event.

Figure 5:
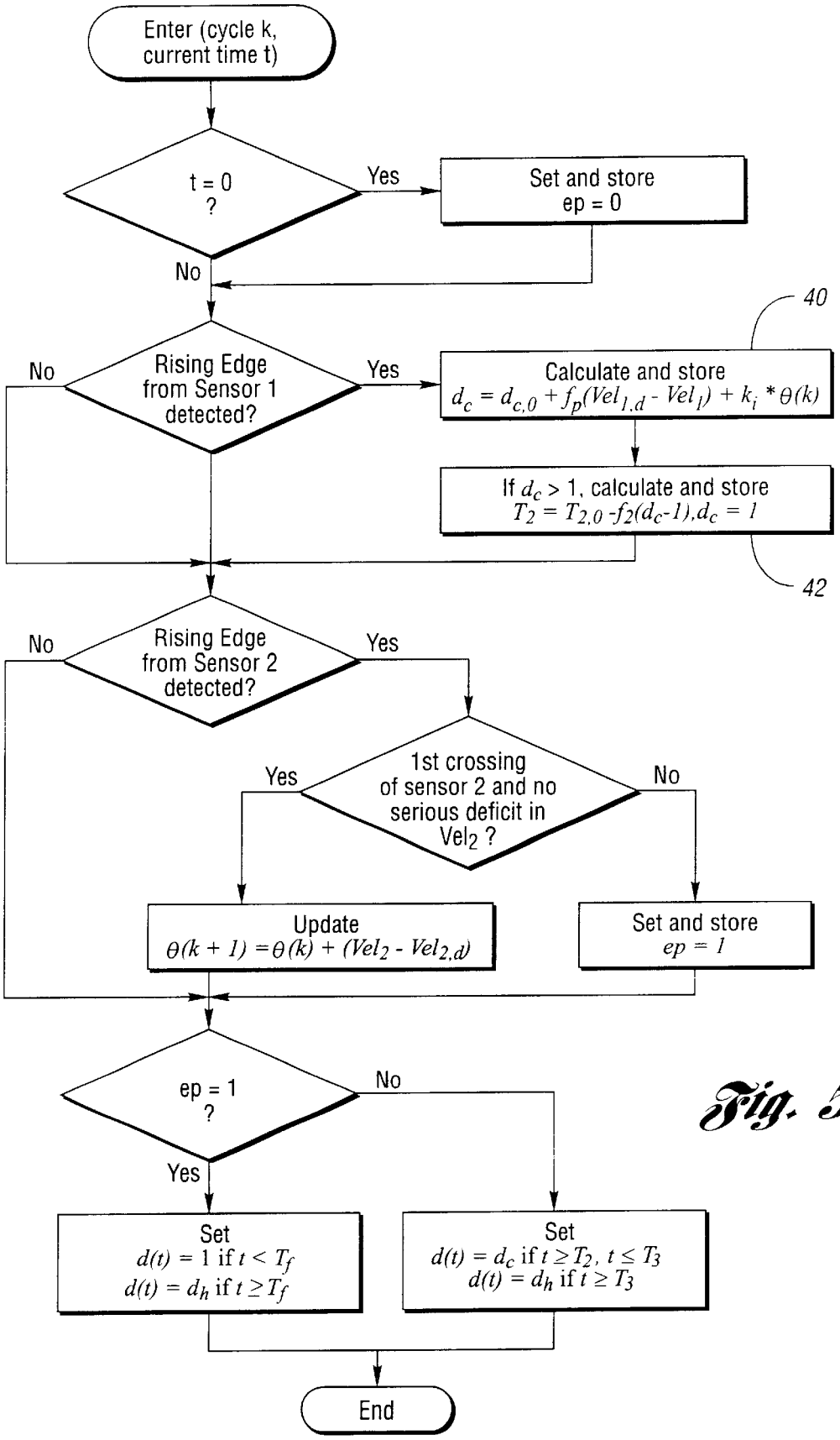
FIG. 5 shows a flow chart of a control scheme in accordance with the present invention.

The main features of the algorithm described in FIG. 5 are as follows.

If the estimated velocity at the first sensor crossing, $Vel_1$, is below the desired value, $Vel_{1d}$, the value of $d_c$ (i.e., the duty cycle) is increased from its nominal value $d_{c,0}$ by a value, $f_p(Vel_{1,d}-Vel_1)$, whose magnitude is a faster than linear increasing function of the magnitude of the difference. This calculation is shown at block 40 in FIG. 5, where $f_p$ is a calibratable gain. The increase in $d_c$ assures armature landing since lower than desired velocity indicates larger than expected disturbances counteracting the motion of the valve 12. Disproportionately more aggressive action is provided for a larger velocity deficit.

If the estimated velocity at the first sensor crossing is above the desired value, the value of $d_c$ may be decreased from its nominal value by a conservative amount that may depend on the magnitude of the difference.

Still referring to block 40, the adaptive term is added to the resulting $d_c$ value to provide cycle-to-cycle adaptation. This adaptive term is formed by multiplying a gain k times the integrator output θ that sums up the past differences between the estimated $Vel_2$ and desired velocity, $Vel_{2,d}$ at the second sensor crossing.

Referring to block 42 of FIG. 5, if the resulting $d_c$ value exceeds one (i.e., not physically realizable), $d_c$ is set to 1 and $T_2$ is advanced from its nominal value $T_{2,0}$ by a value whose magnitude is a monotonic function of the amount by which the originally calculated value of $d_c$ exceeds 1. $T_2$ is the time instant when the duty cycle is applied to effect armature catching. In other words, when greater than 100% duty cycle is demanded, catching current $T_2$ is initiated sooner to compensate for such demand.

Referring to blocks 44 and 46 of FIG. 5, if the value of $Vel_2$ is significantly lower than the desired value $Vel_{2,d}$, or if a second crossing of the second sensor has been detected (indicating the valve 12 starting to move in the opposite direction), an emergency pulse is formed to force the valve landing, wherein the duty cycle $d_c$ is set to the maximum value of 1 until a prespecified time $T_f$ elapses. After the time $T_f$ elapses, the duty cycle $d_c$ is set to the holding duty cycle $d_h$.

The results of simulating the actuator model in the closed loop with the proposed algorithm of FIG. 5 are shown in Table 1 below, and in FIGS. 3*a*–3*c* and 4*a*–4*c*. The unmeasured disturbance acting on the valve is assumed to be of initially persistent ultimately exponentially decaying type, to reflect the fact that the disturbance has initially larger size. In the case when the disturbance acts against the valve motion ("−w") applying the nominal duty cycle profile (i.e. with algorithm off) yields no landing at all (in fact, the armature does not make it to the second sensor location). When the disturbance acts in the direction of the valve motion ("+w"), large landing velocity results with the algorithm off. With the algorithm on, landing is ensured in "−w" case and, in addition, the variability in the landing speed in both cases is greatly reduced. Some residual variability is still present despite the fact that the velocity at the second sensor crossing is regulated to the desired value. This is because some-disturbance does remain and does affect the armature motion even after the second sensor crossing.

TABLE 1

| | w = 0 | −w | +w |
|---|---|---|---|
| With algorithm on | 0.45 | 0.25 | 0.73 |
| With algorithm off | 0.45 | No landing, Never crossed 2nd sensor | 1.75 |

Table 1 illustrates steady state (i.e., after ten cycles) landing velocity w (in meters per second) with and without compensation for the nominal case (w=0) and for the cases when the unmeasured disturbance of initially persistent, ultimately exponentially decaying type is acting on the valve. In the "−w" case, the disturbance opposes the valve opening, while in the "+w" case, the disturbance acts in the direction of valve opening.

Figure 3A:
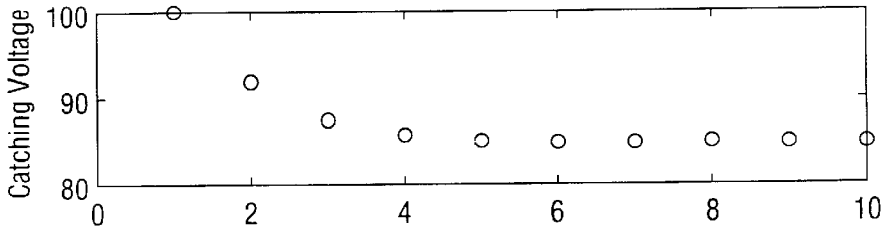
FIGS. 3*a*, 3*b* and 3*c* graphically illustrate catching voltage, landing velocity, and velocity at the second sensor, respectively, versus cycle number in a simulation of the present invention.
Figure 3B:
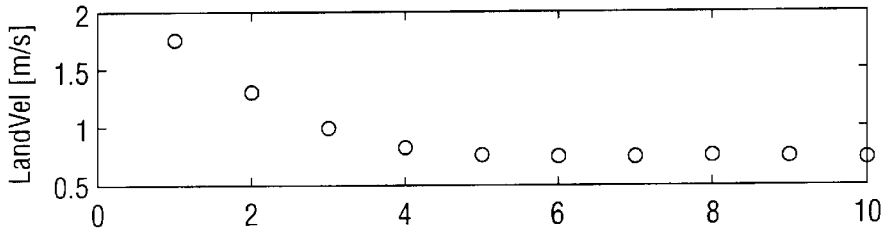
Figure 3C:
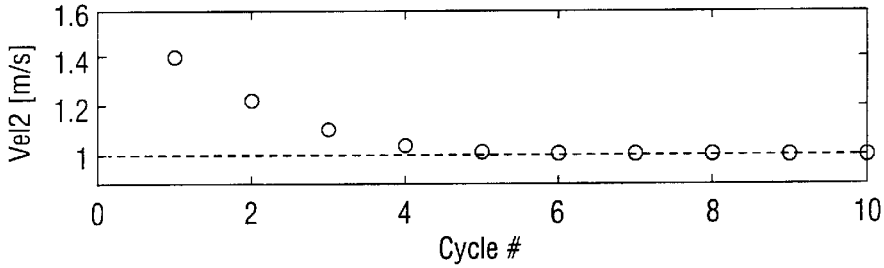

Referring to FIGS. 3*a*–3*c*, the catching voltage $V_c=V_{max \cdot dc}$ ($V_{max}$ equals 200), landing velocity and velocity of the second sensor crossing from one cycle to the next are shown. The desired value of $Vel_{2,d}$ is shown by the dashed line in FIG. 3*c*. The nominal value of $V_c$ is 100. Here, an unknown disturbance force (of initially persistent, ultimately exponentially decaying type) acts on the valve, opposing the armature motion toward the lower coil. The emergency pulse compensation is used on the first and the third cycle to ensure that the armature actually lands. The armature crosses the second sensor location three times on the first and on the third cycle. Aggressive compensation for the difference $Vel_{1,d}-Vel_1$, with $f_p$ ($Vel_{1,d}-Vel_1$) term, is clearly visible on FIG. 3*a* in the first cycle, as well as slower cycle-to cycle adaptation from the difference $Vel_{2,d}-Vel_2$.

Figure 4A:
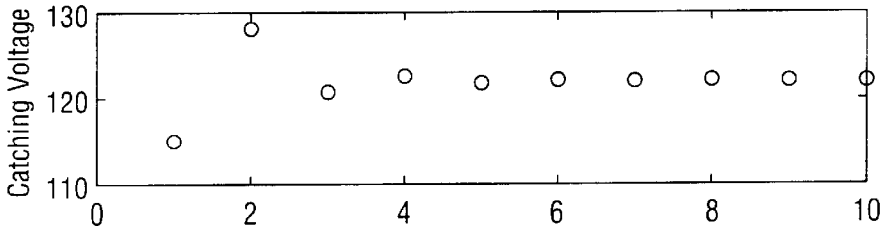
FIGS. 4*a*, 4*b* and 4*c* graphically illustrate catching voltage, landing velocity and velocity at the second sensor, respectively, versus cycle number in a second simulation of the present invention.
Figure 4B:
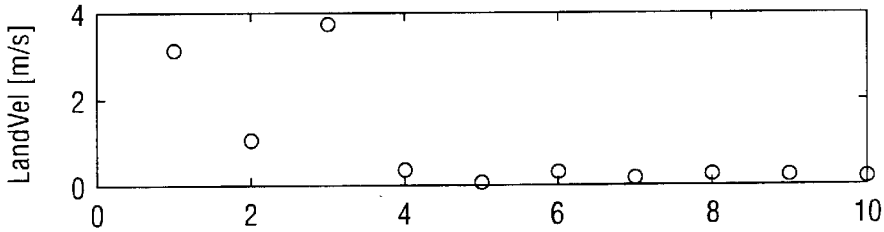
Figure 4C:
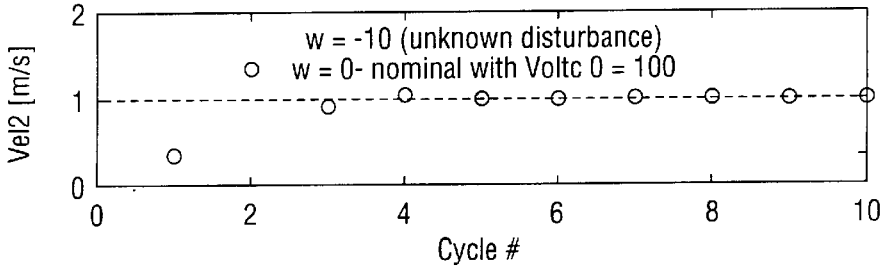

Referring to FIGS. 4*a*–4*c*, the catching voltage $V_c=V_{max}$ $d_c$ ($V_{max}$=200), landing velocity and velocity at the second sensor crossing from one cycle to the next in the "+w" case are shown. The desired value of $Vel_{2,d}$ is shown by the dashed line on FIG. 4*c*. The nominal value of $V_c$ is 100. Here, an unknown disturbance force (of initially persistent, ultimately exponentially decaying type) acts on the valve, accelerating the armature toward the lower coil. Here (for illustration purposes), the action $f_p$ ($Vel_{1,d}-Vel_1$) on the velocity difference at the first crossing was set to zero, to illustrate the effect of cycle-to-cycle adaptation.

While the best mode for carrying out the invention has been described in detail, those familiar with the art to which this invention relates will recognize various alternative designs and embodiments for practicing the invention within the scope of the appended claims.

What is claimed is:

1. A method of determining valve velocity in a camless engine including a valve movable between fully open and fully closed positions, and an electromagnetic valve actuator (EVA) for actuating the valve, the method comprising:

providing a first position measurement sensor at a middle location to sense the crossing of the valve at a first position between the fully open and fully closed positions;

providing a second position measurement sensor at a nearly-closed location to sense crossing of the valve near the fully closed position;

providing a third position measurement sensor at a nearly-open location to sense crossing of the valve near the fully open position; and calculating the velocity of the valve at said particular positions based upon current and rate of change of current in the electromagnetic valve actuator when the valve is at said particular position.

2. The method of claim 1, wherein said step of calculating the velocity of the valve at said particular position comprises calculating the velocity of the valve at the first, second and third positions.

3. The method of claim 2, further comprising using the calculated velocity at said first position to control valve landing in the same valve cycle, and using the calculated velocity at the second and third positions to control valve landing in a subsequent valve cycle.

4. The method of claim 1, wherein said step of calculating the velocity of the valve is performed by the following formula:

$$Velocity = \frac{\left(\frac{z+k_b}{k_a}\right) - (L \cdot i - \varepsilon) + r \cdot i - V}{i\frac{k_a}{(z+k_b)^2}}$$

where z is the armature position (distance from a fully open or fully closed position), r is electrical resistance of the EVA, V is voltage across the EVA, i is measured current through the EVA, $k_a$ and $k_b$ are calibrated constants, and ($L \cdot i - \epsilon$) is an estimate of the time rate of change of current.

5. The method of claim 4, wherein said estimated time rate of change of current is derived from the formulas:

$$\frac{di}{dt}(\text{estimate}) = L \cdot i - \varepsilon$$

$$\frac{d\varepsilon}{dt} = -L \cdot (L \cdot i - \varepsilon)$$

where L is an estimator gain.

6. The method of claim 5, wherein said constants $k_a$ and $k_b$ are calibrated from the relation between the force on a movable armature of the EVA and the distance of the armature from a fully open position in accordance with the following formula:

$$F_{mag} = \frac{k_a i^2}{(z + k_b)^2},$$

where $F_{mag}$ is an electromagnetic field force from an energized coil.

7. The method of claim 1, further comprising controlling valve landing at said fully open and fully closed positions by adjusting a duty cycle of the EVA in response to said calculated velocities.

8. A method of controlling valve landing in a camless engine including a valve movable between fully open and fully closed positions, and an electromagnetic valve actuator (EVA) for actuating the valve, the method comprising:

providing a first position measurement sensor at a middle location to sense crossing of the valve at a first position between the fully open and fully closed positions;

providing a second position measurement sensor at a nearly-closed location to sense crossing of the valve near the fully closed position;

providing a third position measurement sensor at a nearly-open location to sense crossing of the valve near the fully open position;

estimating the velocity of the valve at said particular positions based upon current and rate of change of current in the electromagnetic valve actuator when the valve is at said particular positions; and controlling valve landing based upon said estimated velocities.

9. The method of claim 8, wherein said step of estimating the velocity of the valve at said particular position comprises estimating the velocity of the valve at the first, second and third positions.

10. The method of claim 9, wherein said step of controlling valve landing comprises using the estimated velocity at said first position to control valve landing in the same valve cycle, and using the estimated velocity at the second and third positions to control valve landing in a subsequent valve cycle.

11. The method of claim 8, wherein said step of estimating the velocity of the valve is performed by the following formula:

$$Velocity = \frac{\left(\frac{z + k_b}{k_a}\right) - (L \cdot i - \varepsilon) + r \cdot i - V}{i\frac{k_a}{(z + k_b)^2}}$$

where z is the armature position (distance from a fully open or fully closed position), r is electrical resistance of the EVA, V is voltage across the EVA, i is measured current through the EVA, $k_a$ and $k_b$ are calibrated constants, and $(L \cdot i - \epsilon)$ is an estimate of time rate of change of current.

12. The method of claim 11, wherein said estimated rate of change of current is derived from the formulas:

$$\frac{di}{dt}(\text{estimate}) = L \cdot i - \varepsilon$$

$$\frac{d\varepsilon}{dt} = -L \cdot (L \cdot i - \varepsilon)$$

where L is an estimator gain.

13. The method of claim 12, wherein said constants $k_a$ and $k_b$ are calibrated from the relation between the force on a movable armature of the EVA and the distance of the armature from a fully open position in accordance with the following formula:

$$F_{mag} = \frac{k_a i^2}{(z + k_b)^2},$$

where $F_{mag}$ is an electromagnetic field force from an energized coil.

14. The method of claim 8, wherein said step of controlling valve landing comprises adjusting a duty cycle of the EVA in response to said estimated velocity.

15. A method of controlling valve landing in a camless engine including a valve movable between fully open and fully closed positions, and an electromagnetic valve actuator (EVA) for actuating the valve, the method comprising:

providing a first position measurement sensor at a middle location to sense the movement of the valve at a first position between the fully open and fully closed positions;

providing a second position measurement sensor at a nearly-closed location to sense movement of the valve near the fully closed position;

providing a third position measurement sensor at a nearly-open location to sense movement of the valve near the fully open position;

calculating the velocity of the valve at each said location based upon current and rate of change of current in the electromagnetic valve actuator when the valve is at each said position; and controlling valve landing based upon each said calculated velocity.

* * * * *